US007390274B2

(12) United States Patent
Bradford

(10) Patent No.: US 7,390,274 B2
(45) Date of Patent: Jun. 24, 2008

(54) BASKETBALL NET

(76) Inventor: William L. Bradford, 1626 N. Wilcox Ave., #200, Detroit, MI (US) 90028

( * ) Notice: Subject to any disclaimer, the term of this patent is extended or adjusted under 35 U.S.C. 154(b) by 46 days.

(21) Appl. No.: 11/223,230

(22) Filed: Sep. 12, 2005

(65) Prior Publication Data

US 2007/0060420 A1 Mar. 15, 2007

(51) Int. Cl.
*A63B 63/08* (2006.01)

(52) U.S. Cl. ..... 473/485; D21/701

(58) Field of Classification Search ..... 473/480, 473/479, 494, 476, 485, 489; D21/701
See application file for complete search history.

(56) References Cited

U.S. PATENT DOCUMENTS 3,109,647 A * 11/1963 Austin ..... 473/485
4,759,963 A * 7/1988 Uso et al. ..... 428/100
5,098,091 A * 3/1992 McGivern ..... 473/489
D365,613 S * 12/1995 Rothbard ..... D21/701
D366,078 S * 1/1996 Rothbard ..... D21/701
5,735,760 A * 4/1998 Brewer ..... 473/485
5,944,623 A * 8/1999 Schlicting ..... 473/489
6,746,349 B2 * 6/2004 Neiberger et al. ..... 473/485
7,094,166 B2 * 8/2006 Beane ..... 473/485

* cited by examiner

*Primary Examiner*—Gene Kim
*Assistant Examiner*—M. Chambers
(74) *Attorney, Agent, or Firm*—Kevin C. Ward

(57) ABSTRACT

The disclosed basketball net has enhanced sound making ability due to a series of strips attached to a rung of the net. These strips are made from a flexible material and make sound when contacted by a basketball passing through the net. The strips can have an air pocket which collapses due to the force of the basketball moving along it, creating a loud sound as the surfaces of the strip collide against each other. Embodiments of the present invention having strips with no air pockets as well as noise making materials on the inner surfaces of the strips are shown.

7 Claims, 3 Drawing Sheets

BASKETBALL NET

FIELD OF THE INVENTION

The present invention relates generally to basketball nets. More particularly, this invention relates to basketball nets having enhanced sound making abilities.

BACKGROUND OF THE INVENTION

Basketball nets serve many purposes. The primary one is to catch and slow down the basketball after a goal is made. This saves the players and officials a great deal of effort and time that would otherwise be expended in chasing the ball and allows the game to play at a faster pace.

A very important secondary purpose of a basketball net, particularly in situations involving competitive play without the benefit of formal officiating, is to signify that a goal has actually been made. Indeed, the sound of a basketball passing through the net is one of the most satisfying in sports, described with such phrases as "nothing but the bottom of the net", "nothing but nylon", and "swish."

However, the basketball nets currently in use leave much to be desired. For one thing, the sound of a basketball hitting against the outside of the net can be very close, if not indistinguishable, from that of a basketball going through the net. For another, as the nylon cord that comprises the net ages, it becomes weaker, thereby diminishing the sound emitted when a basketball passes through. This wear and tear is particularly apparent at the bottom of the net, where the basketballs exert the most contact force as they pass through the net. To ensure that the net continues to make a sound as the ball passes through it, it is necessary to purchase additional nets and spend the time installing them, which is both costly and time consuming. The alternative, to not use a net at all, is even less appealing for most basketball players.

There are examples in the prior art which teach basketball nets with enhanced sound making abilities. For example, U.S. Pat. No. 5,813,928 to Hsieh shows a net with a sensing body which triggers an audio-photo element, producing an audio-photo effect when the ball passes through the net. While such nets do provide enhanced sound making abilities, they rely on electronics, thus making the cost of the nets more expensive and raising issues of damage to the electronics from the impact of the ball, for example.

Thus, there exists a need for an economical basketball net with enhanced sound making ability which does not rely on electronic sensors or devices.

SUMMARY OF THE INVENTION

An improved basketball net, suitable for both indoor and outdoor play, is achieved by modifying a traditional basketball net by adding strips to a lower rung of the net, preferably, the bottom. As used herein, a rung is a roughly horizontal level which results from making the net by tying a cord together. Strips may be made of any flexible material, such as leather, vinyl, or rubber, and may have varying lengths and colors.

The invention is defined in the appended claims, some of which may be directed to some or all of the broader aspects of the invention set forth above, while other claims may be directed to specific novel and advantageous features and combinations of features that will be apparent from the description that follows.

BRIEF DESCRIPTION OF THE DRAWINGS

It is to be expressly understood that the following figures are merely examples and are not intended as a definition of the limits and scope of the present invention.

DETAILED DESCRIPTION OF THE PREFERRED EMBODIMENTS

Figure 1:
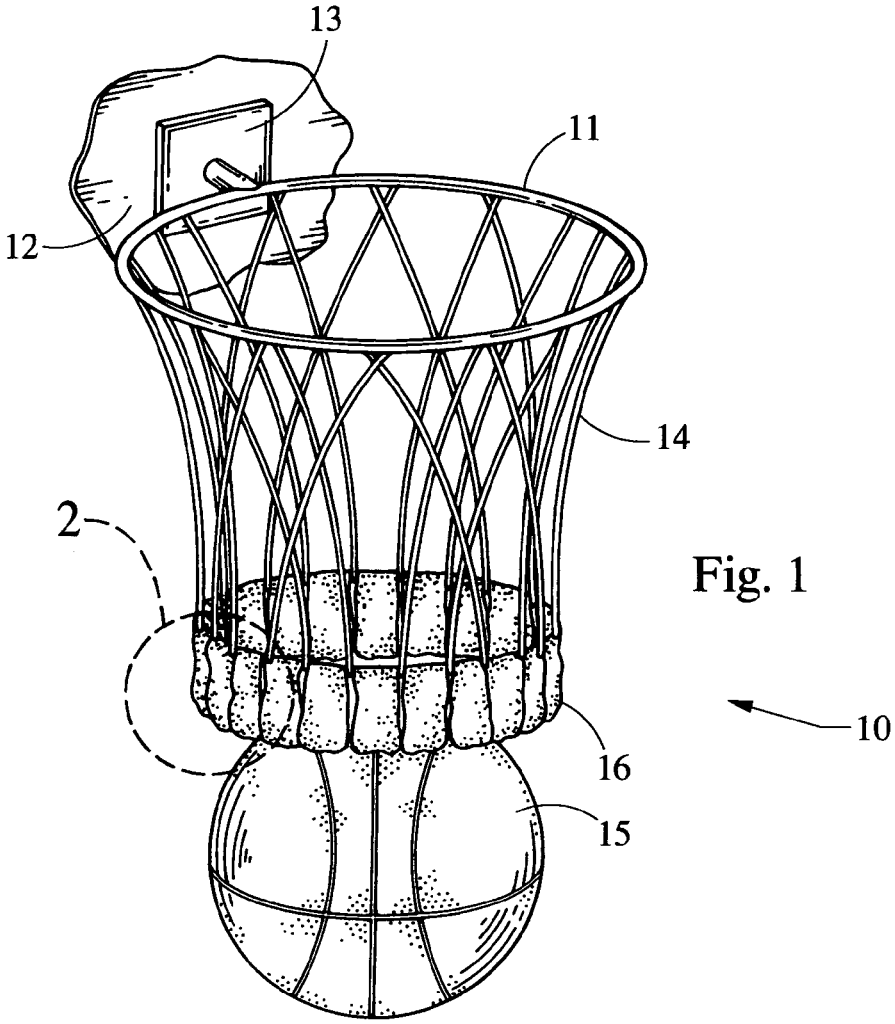
FIG. 1 is a perspective view of a basketball passing through a first preferred embodiment of the present invention.

Hereinafter, some embodiments of the present invention will be described in detail with reference to the related drawings of FIGS. 1-7. Additional embodiments, features, and/or advantages of the invention will become apparent from the ensuing description or may be learned by the practice of the invention. In the figures, the drawings are not necessarily to scale and reference numerals indicate the various features of the invention, like numerals referring to like features throughout both the drawings and the description. The description is not to be taken in a limiting sense, but is made solely for the purpose of describing the general principles of the invention.

Figure 2:
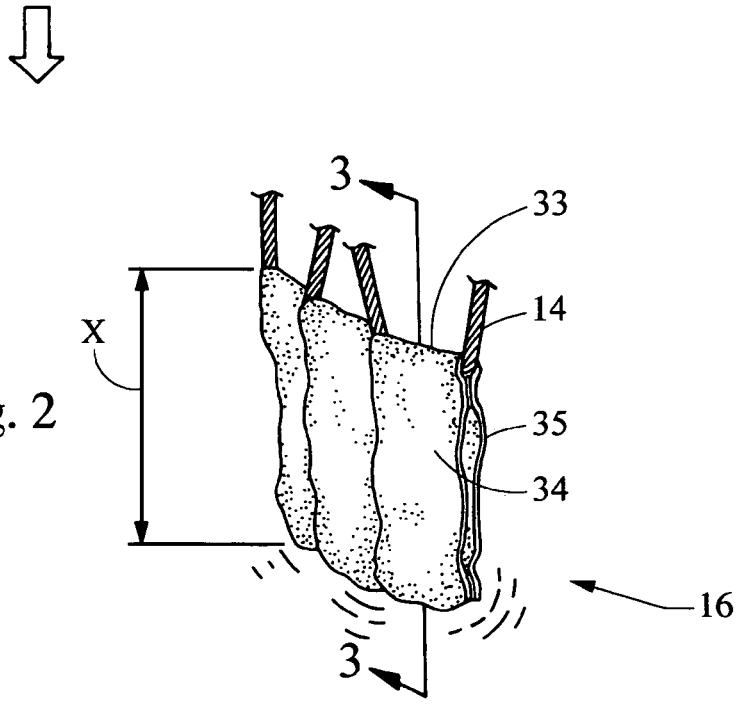
FIG. 2 is a perspective view of a series of the strips on the bottom rung of the first preferred embodiment of the present invention.

Referring now to FIGS. 1 and 2, a conventional basketball goal 10 having a rim 11 attached to a backboard 12 by means of an attachment bracket 13 is shown. A nylon basketball net 14 has a basketball 15 passing through it, exiting past a series of strips 16. FIG. 2 is a side perspective view of the dotted circle 2 shown in FIG. 1. Each bottom rung of the net 14 has a strip 16 on it. The strip 16 has a top surface 33, an outer surface 34 and an inner surface 35. The X variable is meant to signify that the length of the strips may vary in relation to the net 14.

Figure 3:
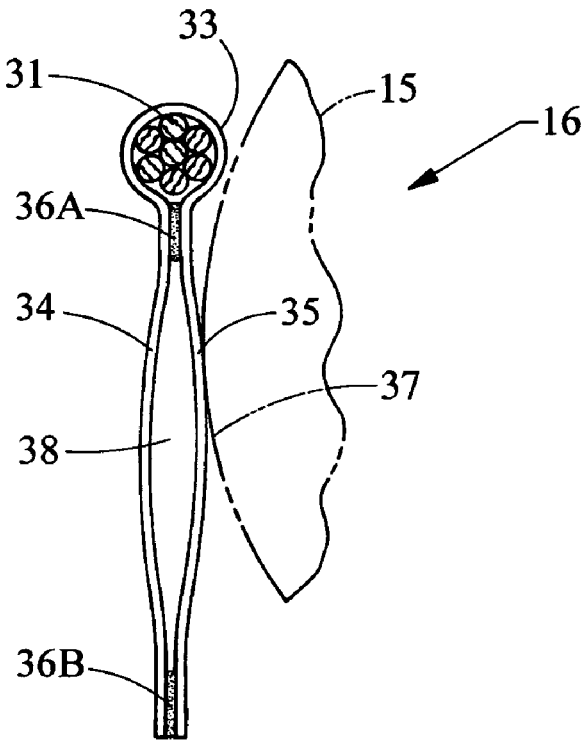
FIG. 3 is a perspective view of a basketball coming in contact with a strip of the first preferred embodiment of the present invention.
Figure 4:
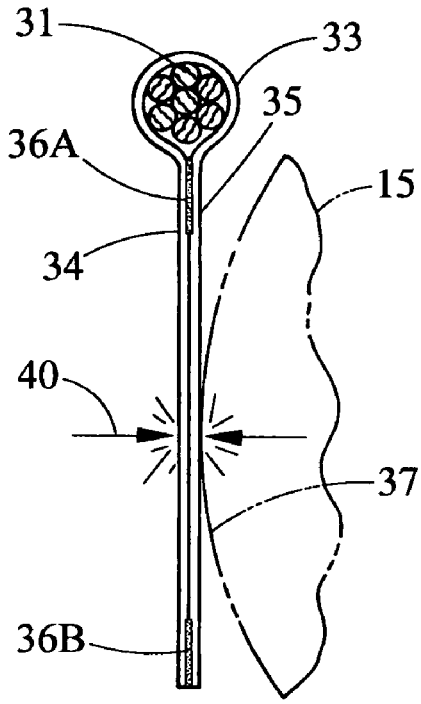
FIG. 4 is a perspective view of a basketball passing along a strip of the first preferred embodiment of the present invention.

Referring now to FIGS. 3 and 4, the use of the first preferred embodiment of the present invention can be explained. A side cut view of a strip 16 shows the strip 16 forming a loop over the individual nylon strands 31 of the net (not shown). The strip 16 is sealed at an upper attachment point 36A and a lower attachment point 36B by use of glue, forming an air pocket 38 within the strip 16. The strip 16 has an outer surface 34 and an inner surface 35. As the outer surface 37 of the basketball 15 contacts and moves along the inner surface 35 of the strip, the inner surface 35 and the outer surface 34 of the strip 16 are brought together in a whip-like action, as demonstrated by arrow 40, thereby removing the air pocket 38 and creating a loud sound. It is this action that allows the first preferred embodiment of the present invention to make a higher level of sound as compared to the conventional nylon basketball net.

Figure 5:
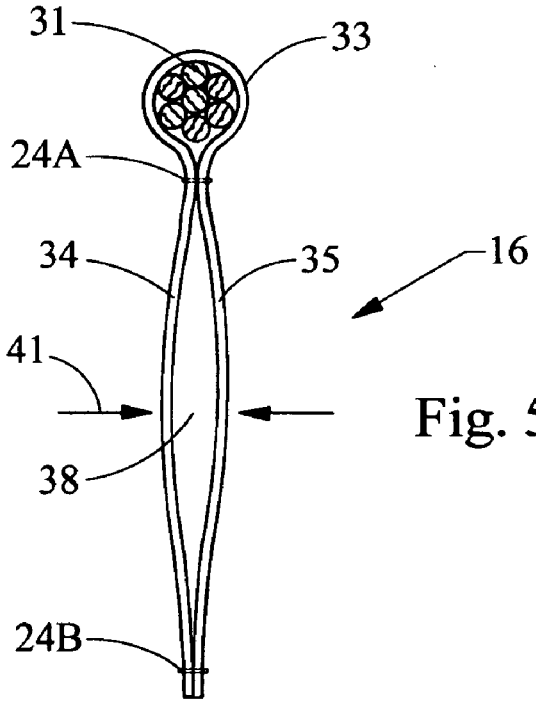
FIG. 5 shows an alternative method of forming the attachment points on a strip of a second preferred embodiment of the present invention.

Referring now to FIG. 5, a second preferred embodiment of the present invention is shown. This embodiment uses stitching as the attachment means to give the strip 16 an upper attachment point 24A and a lower attachment point 24B. An arrow 41 shows the action that would happen should a basketball such as the one shown FIGS. 3 and 4 pass along it. It should be obvious to those skilled in the art that the method of creating the attachment points 24A, 24B on the strips 16 is independent of the means used. Thus, stitching, Velcro rivets, and other means could also be used for this purpose.

Figure 6:
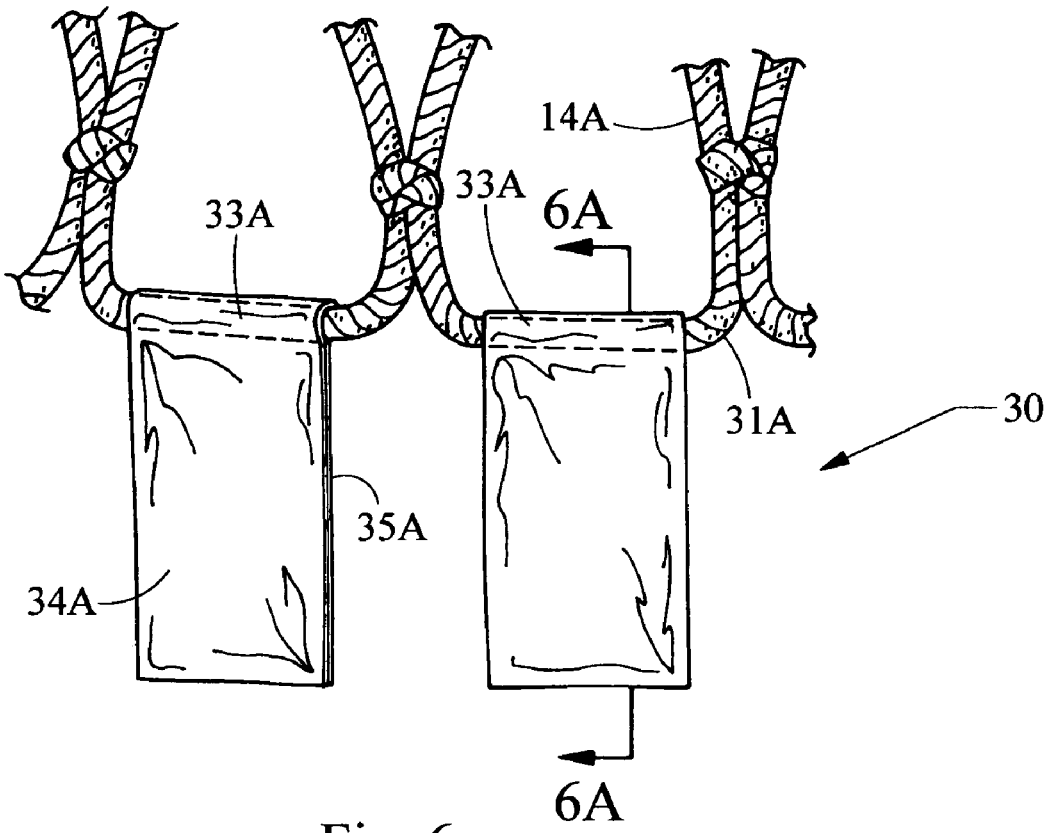
FIG. 6 shows an alternative embodiment of the present invention.
Figure 6A:
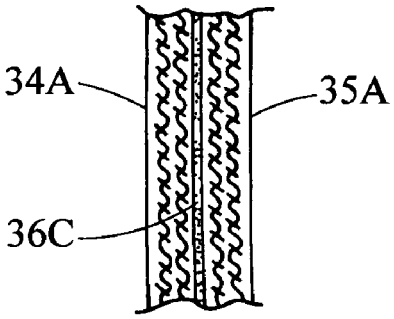
FIG. 6A shows a side cut view of a strip of the alternative embodiment shown in FIG. 6.

Referring now to FIG. 6 and 6A, a different embodiment of the present invention is shown. This strip 30 is wrapped around a net 14A having individual strands 31A and has an upper surface 33A. As shown in FIG. 6A, the outer surface 34A and the inner surface 35A of the strip 30 are held completely together by an attachment point 36C using glue. Again, it should be obvious to those skilled in the art that the method of creating this type of attachment point is independent of the means used, so long as no air pocket is created. Thus, stitching, Velcro, rivets and other means could also be used for this purpose.

Figure 7:
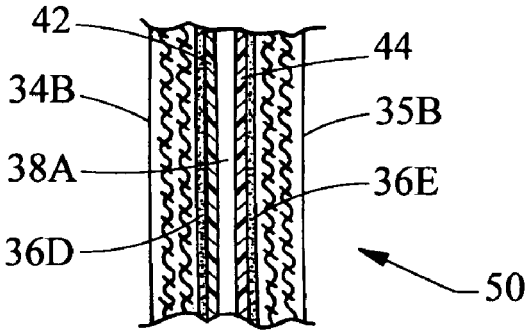
FIG. 7 is a side cut view of a strip of the first preferred embodiment of the present invention with a noise making surface attached to the interior surfaces of the strip.

Finally, referring to FIG. 7, a further embodiment of the present invention is shown. This cut view of a strip 50 shows an outer surface 34B and an inner surface 35B. These surfaces are attached by use of glue to an outer layer 42 and an inner layer 44 of a material, such as a plastic, metal, ceramic, or similar substance, at attachment points 36D and 36E. An air pocket 38A is also shown. This embodiment shows that noise making enhancement materials, or structural support materials, may also be added to the embodiments of the present invention. While glue is used to attach the material layers to the surfaces of the strip in this embodiment, it should be obvious to those skilled in the art that other attachment methods, such as stitching, Velcro, rivets, and other means of attachment could also be used for this purpose.

While the embodiments of the present invention can be made from conventional nylon nets, research has shown that, for best sound results, a net with one or more rungs removed, thus making a shorter net, produces a greater sound effect, as the ball experiences increased contact force against the strips. Similarly, the strips do not necessarily have to be attached to the bottom rung of the net, but louder sounds are produced when the strips are attached in this manner.

Other components and/or configurations may be utilized in the above-described embodiments, provided that such other components and/or configurations do not depart from the intended space of the present invention. While the present invention has been described in detail with respect to the preferred embodiments, it should be appreciated that various modifications and variations may be made in the present invention without departing from the scope and spirit of the invention. In this regard it is important to note that practicing the invention is not limited to the applications described hereinabove. Many other applications and/or alterations may be utilized provided that such other applications and/or alterations do not depart from the intended purpose of the present invention.

It should also be appreciated that features illustrated or described as part of one embodiment can be used in other embodiments to provide yet another embodiment such that the features are not limited to the specific embodiments described above. Thus, it is intended that the present invention cover all such modifications, embodiments, and variations so long as they come within the scope of the present invention as set forth in the appended claims and any equivalents thereof as may now or in the future be apparent to those skilled in the relevant arts of the present invention.

What is claimed is:

1. A basketball net comprising:

A first net portion;

A second net portion attached to said first net portion at an end of said first net portion, wherein said second net portion is comprised of at least one strip formed of a flexible material, with said strip having opposing sides and forming at least one air pocket, such that a basketball passing through said first net portion would cause said opposing sides of said strip to come together and collapse said air pocket, thereby emitting a sound.

2. The basketball net as recited in claim 1, wherein said strip is made of leather.

3. The basketball net as recited in claim 2, wherein said leather strip is attached to itself by means of glue.

4. The basketball net as recited in claim 2, wherein said leather strip is attached to itself by means of stitching.

5. The basketball net as recited in claim 2, wherein said leather strip is attached to itself by means of hook and loop fasteners.

6. The basketball net as recited in claim 1, wherein said strip is made from a plurality of leather pieces.

7. The basketball net as recited in claim 1, wherein a layer of material is attached to each of the opposing sides of the strip such that a basketball passing through said first net portion would cause said material layers to come in contact with each other by collapsing said air pocket, thereby emitting a sound.

* * * * *